US009167640B2

(12) United States Patent
Rim et al.

(10) Patent No.: US 9,167,640 B2
(45) Date of Patent: Oct. 20, 2015

(54) PARALLEL-TYPE LED LIGHTING DEVICE

(71) Applicants: Korea Advanced Institute Of Science and Technology, Daejeon (KR); OPTOMIND INC., Suwon-Si, Gyeonggi-do (KR)

(72) Inventors: Chun-taek Rim, Daejeon (KR); Eun-Soo Lee, Daejeon (KR); Bo-hwan Choi, Anyang-si (KR); Bong-cheol Kim, Seoul (KR)

(73) Assignees: Korea Advanced Institute Of Science and Technology, Daejeon (KR); OPTOMIND INC., Suwon-Si (KR)

( * ) Notice: Subject to any disclaimer, the term of this patent is extended or adjusted under 35 U.S.C. 154(b) by 0 days.

(21) Appl. No.: 14/424,801

(22) PCT Filed: Aug. 29, 2013

(86) PCT No.: PCT/KR2013/007784

§ 371 (c)(1),
(2) Date: Feb. 27, 2015

(87) PCT Pub. No.: WO2014/042372

PCT Pub. Date: Mar. 20, 2015

(65) Prior Publication Data

US 2015/0223298 A1 Aug. 6, 2015

(30) Foreign Application Priority Data

Aug. 29, 2012 (KR) ..... 10-2012-0094892

(51) Int. Cl.
*H05B 37/02* (2006.01)
*H05B 41/36* (2006.01)
*H05B 33/08* (2006.01)

(52) U.S. Cl.
CPC ..... *H05B 33/0809* (2013.01)

(58) Field of Classification Search
CPC ..... H05B 37/02; H05B 41/36; H05B 33/08; H05B 33/0803; H05B 33/0809; H05B 33/0887; H02M 3/335
USPC ..... 315/185 R, 200 R, 224–226, 246, 250, 315/291, 307, 308, 312
See application file for complete search history.

(56) References Cited

U.S. PATENT DOCUMENTS

2010/0176737 A1* 7/2010 Nakada et al. ..... 315/219
2013/0320869 A1* 12/2013 Jans et al. ..... 315/186

FOREIGN PATENT DOCUMENTS

JP 2010-153747 A 7/2010
JP 2010-177059 A 8/2010
JP 2011-243361 A 12/2011
KR 10-0982537 B1 9/2010
KR 10-2011-0062243 A 6/2011

OTHER PUBLICATIONS

International Search Report for PCT/KR2013/007784 dated Dec. 26, 2013.

* cited by examiner

*Primary Examiner* — Jimmy Vu
(74) *Attorney, Agent, or Firm* — Sughrue Mion, PLLC

(57) ABSTRACT

The present disclosure provides an AC-direct-type LED-lighting device including compensation circuit for AC input compensation, including a compensation inductor and first compensation capacitor parallelly connected to one terminal of AC input and a second compensation capacitor connected in series; rectifying unit for rectifying output from second compensation capacitor terminals to obtain direct current; and LED array driven by the rectifying unit output, wherein capacities of the first and second compensation capacitors and the compensation inductor and LED array output voltage are determined to cause 0.9 or larger cosine value of a phase, with respect to the AC input voltage, of resulting current obtained by dividing AC input voltage by sum of (i) parallel value of an equivalent impedance $R_e$ of the rectifying unit and LED array and an impedance of the second compensation capacitor and (ii) parallel value of impedances of the compensation inductor and first compensation capacitor.

15 Claims, 11 Drawing Sheets

(a)

(b)

PARALLEL-TYPE LED LIGHTING DEVICE

CROSS REFERENCE TO RELATED APPLICATIONS

This application is a National Stage of International Application No. PCT/KR2013/007784 filed Aug. 29, 2013, claiming priority based on Korean Patent Application No. 10-2012-0094892 filed Aug. 29, 2012, the contents of all of which are incorporated herein by reference in their entirety.

TECHNICAL FIELD

The present disclosure relates to an LC-parallel AC-direct-type light emitting diode (LED) lighting device, and more particularly, to an LC-parallel AC-direct-type LED lighting device configured to provide a control for enhancing characteristics such as output and power factor by using an LED lighting device including a compensation circuit for driving an LED array for LED lighting.

BACKGROUND

The statements in this section merely provide background information related to the present disclosure and do not necessarily constitute prior art.

An LED has many merits including less power consumption, semipermanently long lifetime, brightness characteristic comparable to that of a conventional fluorescent light, and the like, and hence it is a growing trend that a considerable research is performed on the LED around the globe and the LED is steadily and widely used as a lighting source, i.e., an LED light, which is likely to replace the fluorescent light.

The fluorescent light is generally a sort of mercury discharge tube having a negative resistance characteristic, which necessitates a stabilizer as a device for stably maintaining a turn-on state after turning it on by inducing a discharge start of the fluorescent light. The stabilizer serves to apply a high voltage for starting the discharge initially required to turn on the fluorescent light and supply stable voltage and current to the fluorescent light after turning it on.

Unlike the fluorescent light, the lighting using the LED is promptly operable by constant voltage and current without such a component as the stabilizer, and has an advantage that a power required for the LED light to generate a level of illumination equivalent to that of the fluorescent light is as low as a half of that of the fluorescent light. In order to replace the conventional fluorescent light with the LED light, it is sufficient to simply remove the stabilizer and the fluorescent light and to install the LED light.

FIG. 1 is a circuit diagram of an example of a resistance-connected AC-direct-type LED drive circuit.

Although one can only replace a fluorescent light with a resistance-connected LED light, leaving a conventional rapid start stabilizer as installed, as shown in FIG. 1, if the conventional fluorescent light is simply replaced with the LED light, not only the input power factor is degraded, but also a generation of the total harmonic distortion (THD) is increased and it is hard to obtain a desired output power, thus resulting in undesirable output characteristics.

DISCLOSURE

Technical Problem

Therefore, the present disclosure in some embodiments provides enhanced features such as output and power factor by using an LED lighting device including a compensation circuit for driving an LED array for LED lighting.

SUMMARY

According to some embodiments of the present disclosure, an AC-direct-type LED lighting device includes a compensation circuit including a compensation inductor and a first compensation capacitor parallely connected to one terminal of an alternating current (AC) input and a second compensation capacitor connected in series to the parallely-connected compensation inductor and first compensation capacitor, and configured to compensate the AC input, a rectifying unit configured to rectify an output from terminals of the second compensation capacitor to obtain a direct current, and an LED array configured to be driven by an output of the rectifying unit. Capacities of the first compensation capacitor, the second compensation capacitor, and the compensation inductor and an output voltage of the LED array have values that allow a cosine value of a phase, with respect to a voltage of the AC input, of a result (current) obtained by dividing the voltage of the AC input by a sum of (i) a parallel value of an equivalent impedance $R_e$ for the rectifying unit and the LED array and an impedance of the second compensation capacitor and (ii) a parallel value of an impedance of the compensation inductor and an impedance of the first compensation capacitor, to be equal to or larger than 0.9. The capacities of the first compensation capacitor, the second compensation capacitor, and the compensation inductor are set to render the phase of the current to have a power factor of a leading phase with respect to the voltage.

According to another embodiment of the present disclosure, an AC-direct-type LED lighting device includes a compensation circuit, a rectifying unit and an LED array. The compensation circuit includes a third compensation capacitor parallelly connected to an AC input, a compensation inductor and a first compensation capacitor parallelly connected to one terminal of the AC input, and a second compensation capacitor connected in series to the parallelly-connected compensation inductor and first compensation capacitor, and it is configured to compensate the AC input. The rectifying unit is configured to rectify an output from terminals of the second compensation capacitor to obtain a direct current. The LED array is configured to be driven by an output of the rectifying unit. The capacities of the first compensation capacitor, the second compensation capacitor, the third compensation capacitor and the compensation inductor, and an output voltage of the LED array are determined to cause 0.9 or larger cosine value of a phase, with respect to a voltage of the AC input, of a resulting current $I_1+I_2$ obtained by adding (i) a first result $I_1$ obtained by dividing the voltage of the AC input by a sum of a parallel value of the equivalent impedance $R_e$ of the rectifying unit and the LED array and an impedance of the second compensation capacitor and a parallel value of an impedance of the compensation inductor and an impedance of the first compensation capacitor and (ii) a second result $I_2$ obtained by dividing the voltage of the AC input by an impedance $(1/j\omega_s C_3)$ of the third compensation capacitor. The capacities of the first compensation capacitor, the second compensation capacitor, the third compensation capacitor and the compensation inductor may be set up to cause the phase of the resulting current to have a power factor of a leading phase with respect to the voltage.

The equivalent impedance $R_e$ may be proportional to the output voltage of the LED array and inversely proportional to an output power of the LED array. When the value of the compensation inductor has a preset value, the value of the first compensation capacitor may have a value that allows $$\frac{1}{2\pi\sqrt{LC_1}}$$

to be equal to or larger than $3*f_s$ and equal to or smaller than $4*f_s$, where $f_s$ is a frequency of the AC input.

The output voltage of the LED array may have a value corresponding to the state that the change of an output power of the LED elements constituting the LED array is least, the change depending on the number of the LED elements. The value of the second compensation capacitor may allow the output power to have a preset output power value.

According to yet another embodiment of the present disclosure, an AC-direct-type LED lighting device includes a compensation circuit, a rectifying unit and an LED array. The compensation circuit includes a compensation inductor and a first compensation capacitor parallelly connected to one terminal of an AC input and a second compensation capacitor connected in series to the parallelly-connected compensation inductor and first compensation capacitor, and it is configured to compensate the AC input. The rectifying unit is configured to rectify an output from terminals of the second compensation capacitor to obtain a direct current. The LED array is configured to be driven by an output of the rectifying unit. The capacities of the first compensation capacitor, the second compensation capacitor and the compensation inductor, and an output voltage of the LED array are determined to cause a leading phase, with respect to a voltage of the AC input, of a resulting current obtained by dividing the voltage of the AC input by a sum of (i) a parallel value of an equivalent impedance $R_e$ of the rectifying unit and the LED array and an impedance of the second compensation capacitor and (ii) a parallel value of an impedance of the compensation inductor and an impedance of the first compensation capacitor According to yet another embodiment of the present disclosure, an AC-direct-type LED lighting device includes a compensation circuit, a rectifying unit and an LED array. The compensation circuit includes a third compensation capacitor parallelly connected to an AC input, a compensation inductor and a first compensation capacitor parallelly connected to one terminal of the AC input, and a second compensation capacitor connected in series to the parallelly-connected compensation inductor and first compensation capacitor, and it is configured to compensate the AC input. The rectifying unit is configured to rectify an output from terminals of the second compensation capacitor to obtain a direct current. The LED array is configured to be driven by an output of the rectifying unit. The capacities of the first compensation capacitor, the second compensation capacitor, the third compensation capacitor and the compensation inductor, and an output voltage of the LED array are determined to cause a leading phase, with respect to a voltage of the AC input, of a resulting current $I_1+I_2$ obtained by adding (i) a first result $I_1$ obtained by dividing the voltage of the AC input by a sum of a parallel value of the equivalent impedance $R_e$ of the rectifying unit and the LED array and an impedance of the second compensation capacitor and a parallel value of an impedance of the compensation inductor and an impedance of the first compensation capacitor and (ii) a second result $I_2$ obtained by dividing the voltage of the AC input by an impedance $(1/j\omega_s C_3)$ of the third compensation capacitor.

Advantageous Effects

As described above, according to some embodiments of the present disclosure, there is an effect of enhancing characteristics such as output and power factor by using an LED lighting device including a compensation circuit for driving an LED array for LED lighting.

There are further effects that the THD can be reduced by adding a compensation inductor having an appropriate capacity, the power factor can be enhanced by adding a compensation capacitor having an appropriated capacity, and when a compensation capacitor is connected in parallel to an input stage of a rectifying unit, a harmonic inflowing from an LED array can be reduced.

In particular, according to some embodiments of the present disclosure, the power factor of a whole power system can be enhanced by providing a leading-phase load to the power system, so that a required amount of power supply can be reduced for a constant power demand, and hence it provides a considerable effect on a national level.

DETAILED DESCRIPTION

Figure 1:
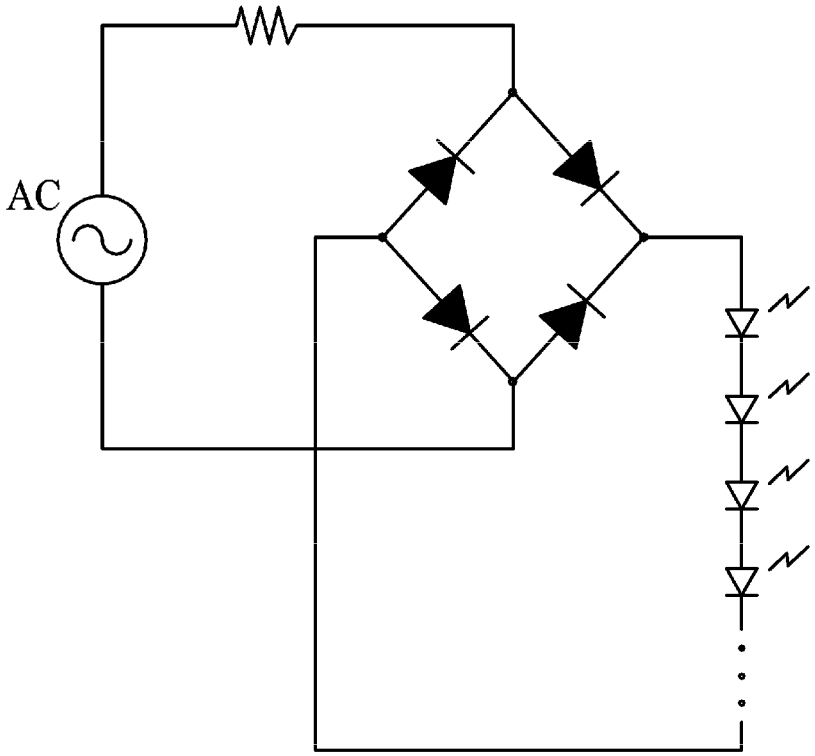
FIG. 1 is an exemplary circuit diagram of a resistance-connected AC-direct-type LED drive circuit.

Hereinafter, at least one embodiment of the present disclosure will be described in detail with reference to the accompanying drawings. In the following description, like reference numerals designate like elements, although the elements are shown in different drawings. Further, in the following description of the at least one embodiment, a detailed description of known functions and configurations incorporated herein will be omitted for the purpose of clarity and for brevity.

Further, terms including first, second, A, B, (a), (b), and the like can be used to describe various constituent elements; however, such terms are merely used to distinguish one constituent element from the other, and one of ordinary skill in the pertinent art would understand the terms are not to imply or suggest the substances, the order or sequence of the constituent elements. If a constituent element is described as 'connected', 'coupled', or 'linked' to another constituent element, one of ordinary skill in the pertinent art would understand the constituent elements are not only necessarily directly 'connected', 'coupled', or 'linked' but also indirectly 'connected', 'coupled', or 'linked' via a third constituent element.

Figure 2:
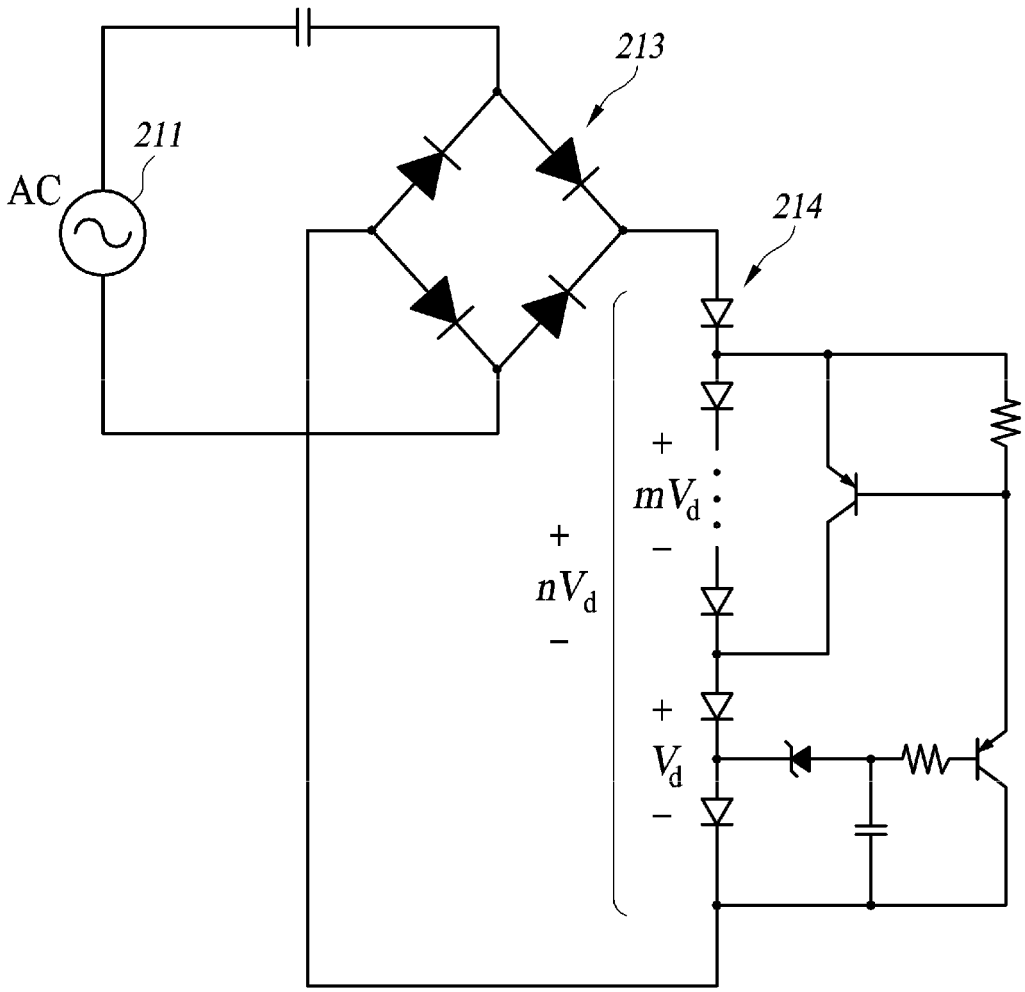
FIG. 2 is an exemplary circuit diagram of a capacitor-type AC drive circuit.

FIG. 2 is an exemplary circuit diagram of the capacitor-type AC drive circuit.

As shown in FIG. 2, a method may be used for rectifying an AC current through a rectifying unit 213 by connecting a capacitor 212 to an AC input 211 and driving an LED array 214. Although this approach provides a simple circuit with high efficiency, it still has drawbacks such that the THD (Total Harmonic Distortion) and the PF (Power Factor) characteristics are degraded.

Figure 3:
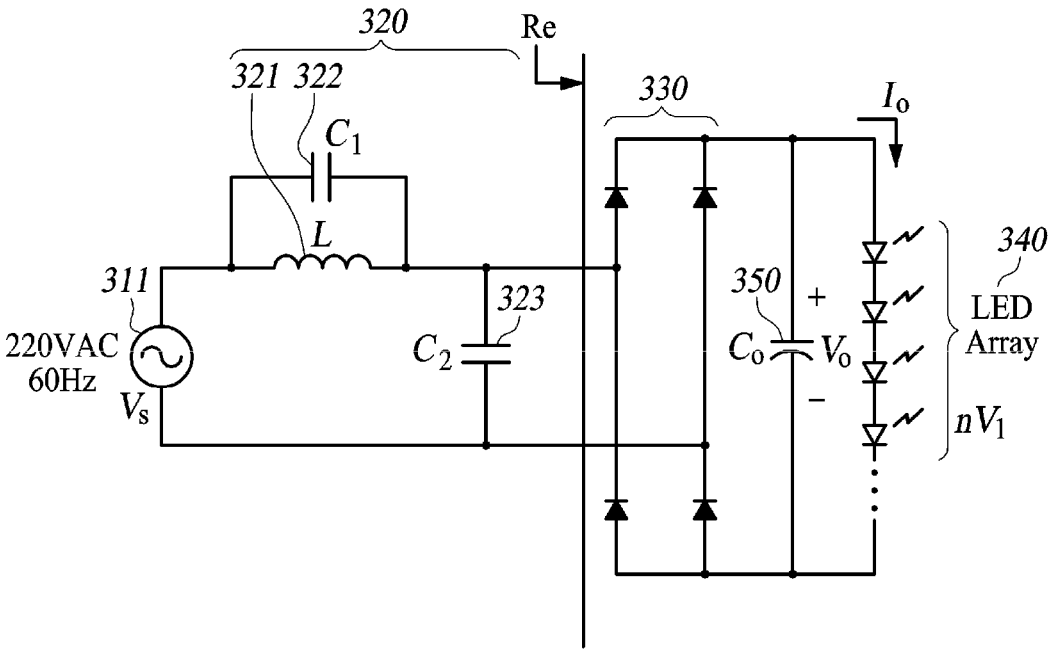
FIG. 3 is a circuit diagram of an LC-parallel AC-direct-type LED lighting device 300 according to a first embodiment of the present disclosure.
Figure 4:
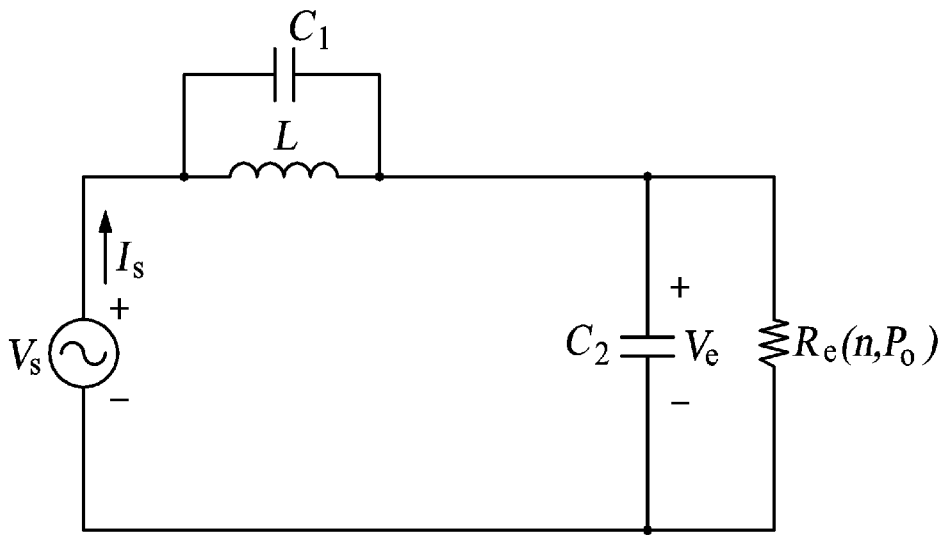
FIG. 4 is an equivalent circuit diagram of the circuit shown in FIG. 3.

FIG. 3 is a circuit diagram of an LC-parallel AC-direct-type LED lighting device 300 according to a first embodiment of the present disclosure, and FIG. 4 is an equivalent circuit diagram of the circuit shown in FIG. 3.

As shown in FIG. 3, the LED lighting device 300 according to the first embodiment of the present disclosure includes a compensation circuit 320 that includes a parallel circuit of a compensation inductor 321 and a first compensation capacitor 322 connected to a sinusoidal AC input 311 inputted from, for example, a household AC terminal and a second compensation capacitor 323 connected in series to the parallel circuit and compensates the AC input 311, a rectifying unit 330 that receives and rectifies an output from terminals of the second compensation capacitor 323, and an LED array 340 that is driven by the output of the rectifying unit 330. The LED array 340 is a device including a plurality of LED elements connected to each other in series, in parallel, or in series and parallel. The AC-direct-type LED lighting device 300 may further include an output capacitor 350 ($C_o$) that is connected to an output stage of the rectifying unit 330 in parallel with the LED array 340 in order to smooth the output of the rectifying unit 330.

As shown in FIG. 3, when the LED array 340 includes n serially-connected LEDs, that is, $V_o \approx nV_1$, where $V_1$ is voltage drop by one LED, and $I_o=P_o/V_o$ with respect to a given output power $P_o$ of the LED array 340. Accordingly, the value of a resistive component of the LED array 340 is $R_o=V_o/I_o=V_o^2/P_o$, and Equation 1 is satisfied with respect to an equivalent impedance $R_e$ for the rectifying unit 330 and the LED array 340 shown in FIG. 3.

Considering a generalized case in which the LED array 340 includes a plurality of LED elements serially and parallely connected with various connection combinations, rather than the n serially-connected LEDs, the equivalent impedance $R_e$ is proportional to the output voltage $V_o$ of the LED array and inversely proportional to the output power $P_o$ of the LED array.

$$R_e=\alpha^2 R_o=\alpha^2 V_o^2/P_o=\alpha^2 n^2 V_1^2/P_o \quad \text{Equation 1}$$

In Equation 1, a is a preset transform equivalent coefficient represented by an equivalence of the rectifying unit. That is, with $V_e=\alpha V_o$ in FIG. 4, Equation 2 is satisfied, where $\omega_s$ is the angular velocity of an input voltage $V_s$.

$$|V_e| = V_s \frac{R_e // \frac{1}{j\omega_s C_2}}{j\omega_s L // \frac{1}{j\omega_s C_1} + R_e // \frac{1}{j\omega_s C_2}} \quad \text{Equation 2}$$

Accordingly, Equation 3 is satisfied.

$$P_e \le \frac{|V_e|^2}{R_e} = P_o \quad \text{Equation 3}$$

The number of LEDs, 'n' can be determined by using Equations 1 and 3 for a given $P_o$. This will be described in detail later.

The capacities of the compensation inductor 321, the first compensation capacitor 322 and the second compensation capacitor 323 shown in FIG. 3 are determined, as defined by Equation 4, so as to cause 0.9 or larger cosine value of a phase ($\phi$), with respect to the voltage $V_s$, of a result (current $I_s$) obtained by dividing the voltage $V_s$ of the AC input 311 by a sum of (i) a parallel value of the equivalent impedance $R_e$ of the rectifying unit 330 and the LED array 340 and an impedance ($1/j\omega_s C_2$) of the second compensation capacitor 323 and (ii) a parallel value of an impedance ($j\omega_s L$) of the compensation inductor 321 and an impedance ($1/j\omega_s C_1$) of the first compensation capacitor 322, and such that the phase ($\phi$) of current $I_s$ is a leading phase, where $\omega_s$ is angular velocity of the input voltage $V_s$.

$$I_s = \frac{V_s}{j\omega_s L // \frac{1}{j\omega_s C_1} + R_e // \frac{1}{j\omega_s C_2}} \quad \text{Equation 4}$$

In other words, when the phase of the current $I_s$ with respect to the voltage $V_s$ is $\phi$, the capacities of the compensation inductor 321, the first compensation capacitor 322 and the second compensation capacitor 323, and the output voltage of the LED array 340 are determined, such that the value of cos $\phi$ is equal to or larger than 0.9. Further, the capacities of the compensation inductor 321, the first compensation capacitor 322 and the second compensation capacitor 323, and the output voltage of the LED array 340 are determined such that the power factor ensures that the phase of the current $I_s$ is a leading phase with respect to the voltage $V_s$. Further, according to Equation 1, the voltage drop $V_1$ per each of the serially-connected LEDs constituting the LED array 340 is virtually constant, and hence a factor for determining the output voltage $V_o=nV_1$ of the LED array 340 is the number 'n' of elements. Consequently, according to Equation 4, the current $I_s$ is influenced by $R_e$, and $R_e$ depends on the value of n, and hence the value of n is one of the key factors of the current $I_s$. In the following descriptions, a fact that a certain element is changed depending on the value of $R_e$ means that the certain element is changed depending on the number 'n' of serially-connected LEDs constituting the LED array 340.

Figure 5:
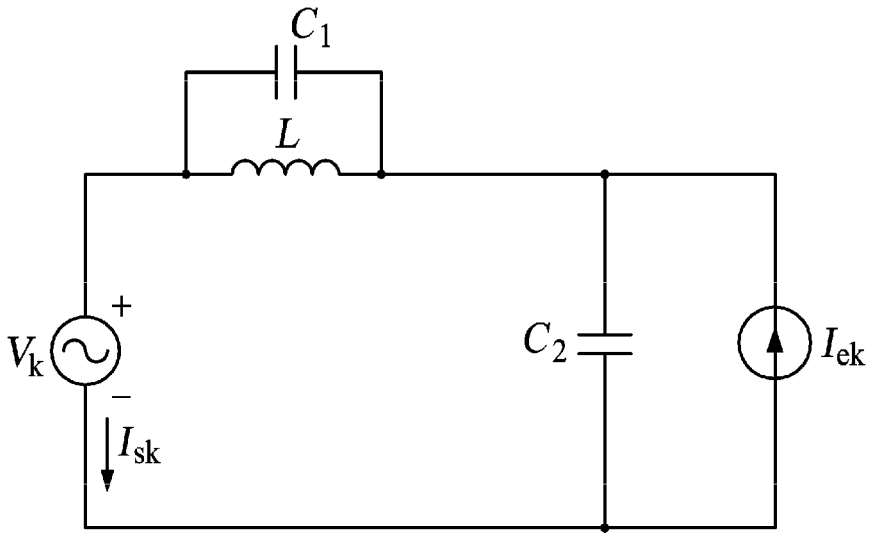
FIG. 5 is a circuit diagram illustrating a $k^{th}$-order-order harmonic current ($I_{ek}$) generated from an LED array 340 and each element.

FIG. 5 is a circuit diagram illustrating a $k^{th}$-order harmonic current ($I_{ek}$) generated from the LED array 340 and each element.

The capacities of the compensation inductor 321, the first compensation capacitor 322 and the second compensation capacitor 323 are set to minimize the THD (e.g., equal to or smaller than 30%).

In FIG. 5, a component ($I_{sk}$) of the $k^{th}$-order harmonic current ($I_{ek}$) flowing into the AC input 311 is defined by Equation 5, and a magnitude of a component of a $5^{th}$ or higher-order harmonic current flowing into the AC input 311 is defined by Equation 6.

$$I_{sk} = \frac{jk\omega_s C_1 + \frac{1}{jk\omega_s L}}{jk\omega_s(C_1 + C_2) + \frac{1}{jk\omega_s L}} I_{ek} \quad \text{Equation 5}$$

$$I_{sk}\Big|_{k\geq 5} \cong \frac{C_1}{C_1 + C_2} I_{ek} \quad \text{Equation 6}$$

In order to zero the value of a $3^{rd}$-order harmonic current flowing into the AC input 311, values of L and $C_1$ need to be set such that a harmonic frequency $f_3$ satisfies Equation 7, and in order to set the value of the $3^{rd}$-order harmonic current $I_{s3}$ flowing into the input, to 25% of a $1^{st}$-order harmonic current $I_{s1}$, the values of L and $C_1$ need to be set to satisfy Equation 8.

$$f_3 = \frac{1}{2\pi\sqrt{LC_1}} = 3f_s \quad \text{Equation 7}$$

$$\frac{1}{2\pi\sqrt{LC_1}} = 4f_s \quad \text{Equation 8}$$

Therefore, when the values of L and $C_1$ are set such that the value of $1/[(2\pi(LC_1)^{1/2}]$ is equal to or smaller than $4*f_s$ and equal to or larger than $3*f_s$ in Equations 7 and 8, the value of the $3^{rd}$-order harmonic current $I_{s3}$ flowing into the AC input 311 becomes equal to or smaller than 25% of the magnitude generated in the LED array 340, and in this case, the total THD becomes equal to or smaller than 30%, where $f_s$ is a frequency at the AC input stage.

Figure 11:
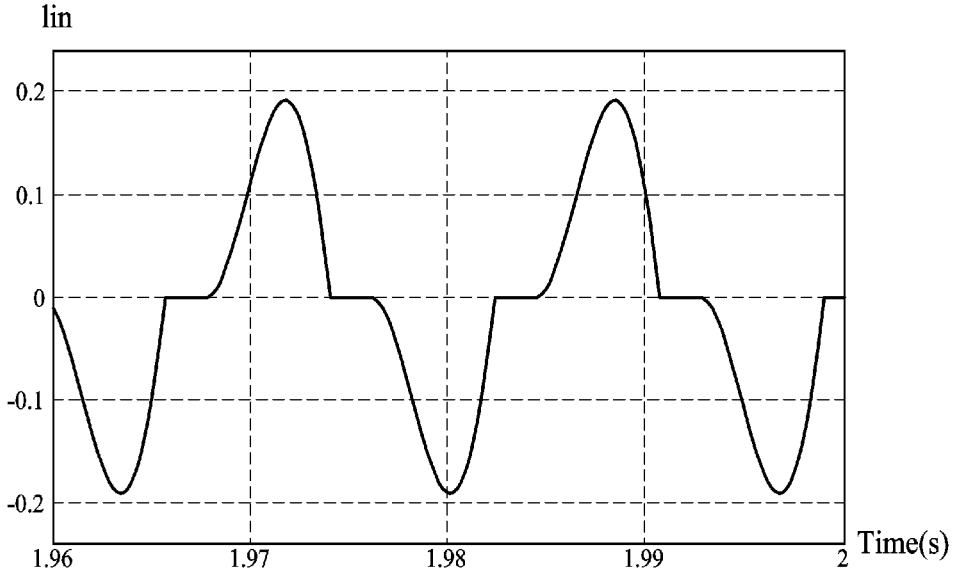
FIG. 11 (*a*) and FIG. 11 (*b*) are graphs showing waves in a compensation inductor 321 when the AC-direct-type LED lighting device 300 operates in a DCM (Discontinuous Current Mode) and in a CCM (Continuous Current Mode).
Figure 11:
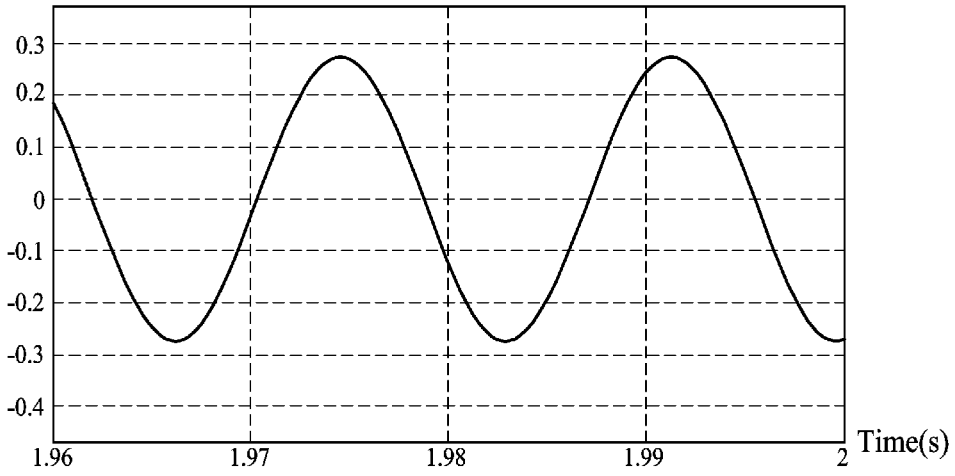

FIG. 11 is a graph showing waves in the compensation inductor 321 when the AC-direct-type LED lighting device 300 operates in DCM (Discontinuous Current Mode) and in CCM (Continuous Current Mode).

The AC-direct-type LED lighting device 300 is operable in DCM ((a) of FIG. 11) or CCM ((b) of FIG. 11). When the number of LEDs in the LED array is constant, a determination of the operation mode depends on the capacity of the compensation inductor 321. In general, the AC-direct-type LED lighting device 300 operates in the CCM when the capacity of the compensation inductor 321 exceeds a predetermined threshold, and the AC-direct-type LED lighting device 300 operates in the DCM when the capacity of the compensation inductor 321 is below the predetermined threshold.

Figure 6:
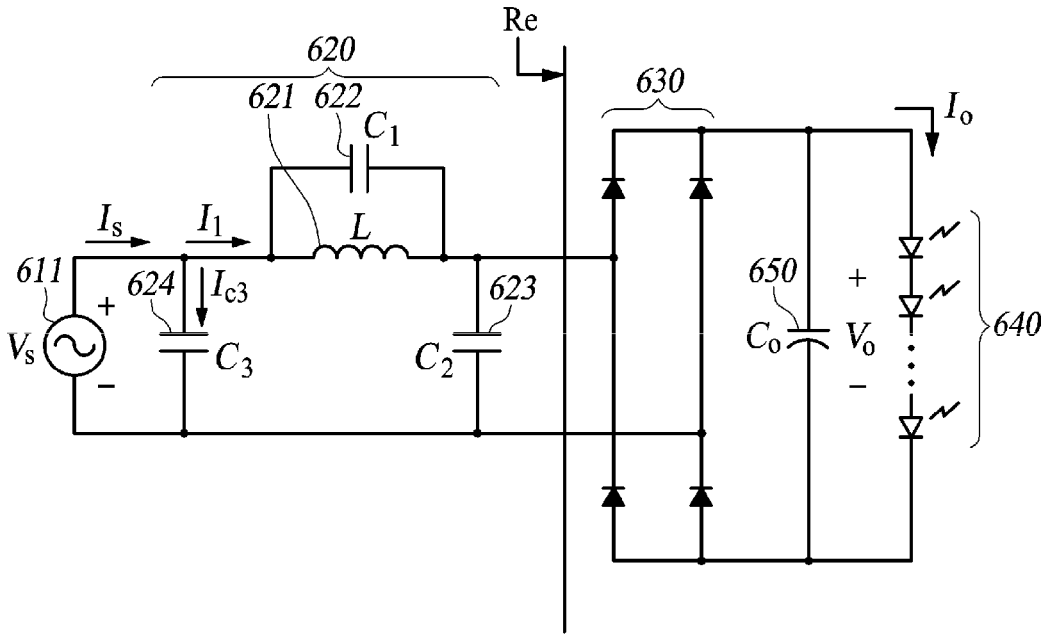
FIG. 6 is a circuit diagram of an LC-parallel AC-direct-type LED lighting device 600 according to a second embodiment of the present disclosure.
Figure 7:
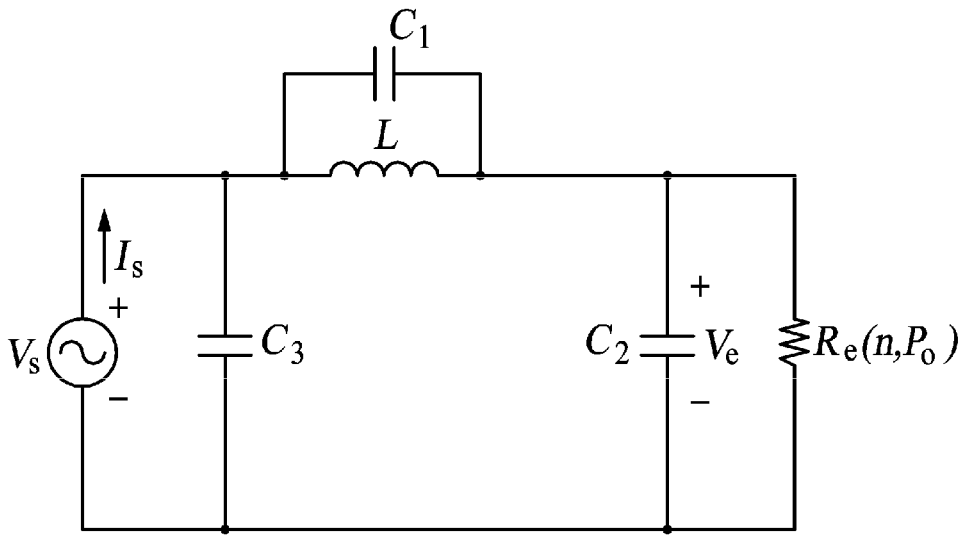
FIG. 7 is an equivalent circuit diagram of the circuit shown in FIG. 6.

FIG. 6 is a circuit diagram of an LC-parallel AC-direct-type LED lighting device 600 according to a second embodiment of the present disclosure, and FIG. 7 is an equivalent circuit diagram of the circuit shown in FIG. 6.

As shown in FIG. 6, the LED lighting device 600 according to the second embodiment of the present disclosure includes a compensation circuit 620 that includes a parallel circuit of a compensation inductor 621 and a first compensation capacitor 622, to which a second compensation capacitor 623, and a third compensation capacitor 624 are connected in series in order to compensate an AC input 611; a rectifying unit 630 that receives and rectifies an output from both terminals of the second compensation capacitor 623; and an LED array 640 that is driven by the output of the rectifying unit 630. The sinusoidal AC input 611 inputted from, for example, a household AC terminal is connected to both terminals of the third compensation capacitor 624, and the parallel circuit of the compensation inductor 621 and the first compensation capacitor 622 is connected between the third compensation capacitor 624 and the second compensation capacitor 623. The LED array 640 is a device including a plurality of LED elements connected to each other in series, in parallel, or in series and parallel. The AC-direct-type LED lighting device 600 may further include an output capacitor 650 ($C_0$) that is connected to an output stage of the rectifying unit 630 in parallel with the LED array 640 in order to smooth the output of the rectifying unit 630.

As shown in FIG. 6, when the LED array 640 includes n serially-connected LEDs, $V_o \approx nV_1$, where $V_1$ is voltage drop by one LED, and $I_o = P_o/V_o$ with respect to a given output power $P_o$ of the LED array 640. Accordingly, the value of a resistive component of the LED array 640 is $R_o = V_o/I_o = V_o^2/P_o$, and Equation 1 is satisfied with respect to an equivalent impedance $R_e$ for the rectifying unit 630 and the LED array 640 shown in FIG. 6.

Further, as $V_e = \alpha V_o$ in FIG. 7, Equations 2 and 3 are satisfied in a manner similar to the case shown in FIG. 3.

Therefore, by using a simultaneous equation of Equations 1 and 3, the number of LEDs, n can be determined with respect to a given $P_o$.

The capacities of the compensation inductor 621, the first compensation capacitor 622, the second compensation capacitor 623 and the third compensation capacitor 624, and the output voltage of the LED array 640 shown in FIG. 6 are determined, as defined by Equation 9, so as to cause 0.9 or larger cosine value of a phase ($\phi$), with respect to the voltage $V_s$, of a result (current $I_1+I_2$) obtained by adding (i) a value (current $I_1$) obtained by dividing the voltage $V_s$ of the AC input 611 by a sum of a parallel value of the equivalent impedance $R_e$ of the rectifying unit 630 and the LED array 640 and an impedance ($1/j\omega_s C_2$) of the second compensation capacitor 623 and a parallel value of an impedance ($j\omega_s L$) of the compensation inductor 621 and an impedance ($1/j\omega_s C_1$) of the first compensation capacitor 622 and (ii) a value (current $I_2$) obtained by dividing the voltage $V_s$ of the AC input 611 by an impedance $1/j\omega_s C_3$ of the third compensation capacitor 624, and such that the phase ($\phi$) of current $I_1+I_2$ is a leading phase, where $\omega_s$ is angular velocity of the input voltage $V_s$.

$$I_s = \frac{V_s}{\frac{1}{j\omega_s C_3} + j\omega_s L // \frac{1}{j\omega_s C_1} + R_e // \frac{1}{j\omega_s C_2}} \quad \text{Equation 9}$$

Therefore, when the phase of the current $I_s$ with respect to the voltage $V_s$ is $\phi$, the capacities of the compensation inductor 621, the first compensation capacitor 622, the second compensation capacitor 623 and the third compensation capacitor 624, and the output voltage of the LED array 640 are determined, such that the value of $\cos\phi$ (i.e., power factor) is equal to or larger than 0.9. Similarly, the output voltage of the LED array 640 depends on the number of LEDs connected in series constituting the LED array 640. In other words, an adjustment of n is a factor for adjusting the phase of the current $I_s$ with respect to the voltage $V_s$.

The capacities of the compensation inductor 621, the first compensation capacitor 622, the second compensation capacitor 623 and the third compensation capacitor 624 are set to minimize the THD (e.g., equal to or smaller than 30%).

Figure 8:
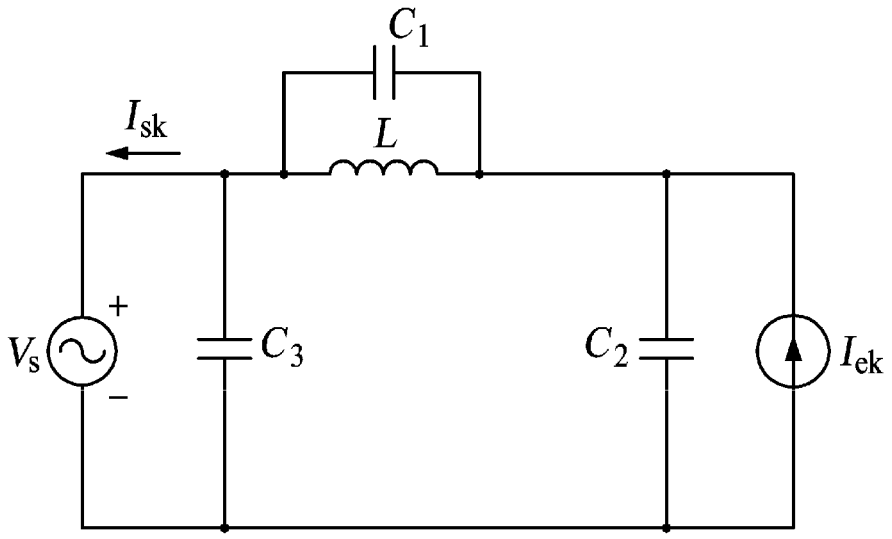
FIG. 8 is a circuit diagram illustrating a $k^{th}$-order-order harmonic current ($I_{ek}$) generated from an LED array 640 and each element.

FIG. 8 is a circuit diagram illustrating a $k^{th}$-order harmonic current ($I_{ek}$) generated from the LED array 640 and each element.

As the value of the third compensation capacitor 624 ($C_3$) is set to a value even smaller than that of the first compensation capacitor 622 ($C_1$), an impedance by $C_3$ has a considerably large value. Therefore, in FIG. 8, the $k^{th}$-order harmonic current $I_{ek}$ hardly flows to the third compensation capacitor 624, and most of the current flows into the AC input stage. Accordingly, the component ($I_{sk}$) of the $k^{th}$-order harmonic current $I_{ek}$ flowing into the AC input 611 becomes substantially equal to that obtained from Equation 5, and the magnitude of a component of a $5^{th}$ or higher-order harmonic current flowing into the AC input 611 is equal to that obtained from Equation 6.

In order to zero the value of a $3^{rd}$-order harmonic current flowing into the AC input 611 to zero, values of L and $C_1$ need to be set such that the $3^{rd}$-order harmonic frequency satisfies Equation 7, and in order to set the value of the $3^{rd}$-order harmonic current $I_{s3}$ flowing into the AC input 611, to 25% of a $1^{st}$-order harmonic current $I_{s1}$, the values of L and $C_1$ need to be set to satisfy Equation 8.

Therefore, when the values of L and $C_1$ are set such that the value of $1/[(2\pi(LC1)^{1/2}]$ is equal to or smaller than $4*f_s$ and equal to or larger than $3*f_s$ in Equations 7 and 8, the value of the $3^{rd}$-order harmonic current $I_{s3}$ flowing into the input becomes equal to or smaller than 25% of the magnitude generated in the LED array 640, and in this case, the total THD becomes equal to or smaller than 30%.

The AC-direct-type LED lighting device 600 is operable in DCM ((a) of FIG. 11) or CCM ((b) of FIG. 11). When the number of LEDs in the LED array is constant, a determination of the operation mode depends on the capacity of the compensation inductor 621. In general, the AC-direct-type LED lighting device 600 operates in the CCM when the capacity of the compensation inductor 621 exceeds a predetermined threshold, and the AC-direct-type LED lighting device 600 operates in the DCM when the capacity of the compensation inductor 621 is below the predetermined threshold.

Figure 9:
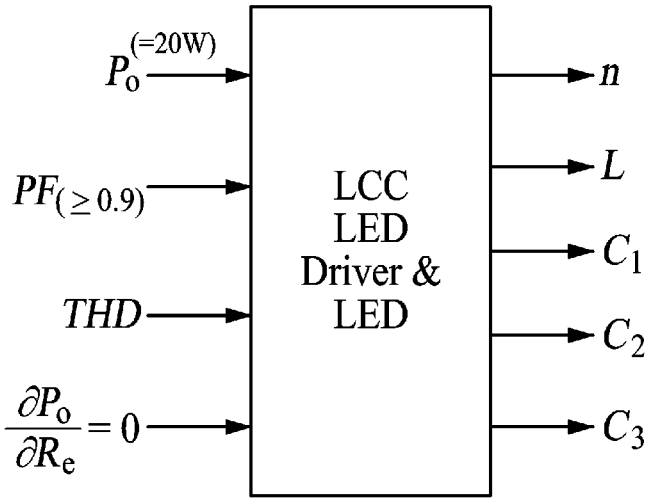
FIG. 9 is a schematic diagram for illustrating a method of designing a light system according to some embodiments of the present disclosure.

FIG. 9 is a schematic diagram for illustrating a method for designing a light system according to some embodiments of the present disclosure.

Firstly, the value of the compensation inductor (L) is set to the minimum value in a range of PF equal to or larger than 0.9 and in a range of THD equal to or smaller than 30%. The value of the compensation inductor L has a predetermined specific value, for example, 0.2 H. Although the PF and THD characteristics are enhanced as the capacity of the compensation inductor L is increased, it also increases in size, and hence the economic feasibility is degraded. Therefore, the capacity of the compensation inductor L is set to a value in a range from 0.1 H to 1.5 H (for example, 0.2 H), considering a tradeoff between the above-mentioned factors.

Upon determining the capacity of the compensation inductor L, the capacity of the first compensation capacitor 622 is determined. The capacity of the first compensation capacitor 622 is determined based on Equation 7 or 8, or determined to have a value in a range between the value obtained from Equation 7 and the value obtained from Equation 8. In other words, a resonant frequency by the compensation inductor L and the first compensation capacitor 622 can be set to a value between $3*f_s$ and $4*f_s$.

Figure 10:
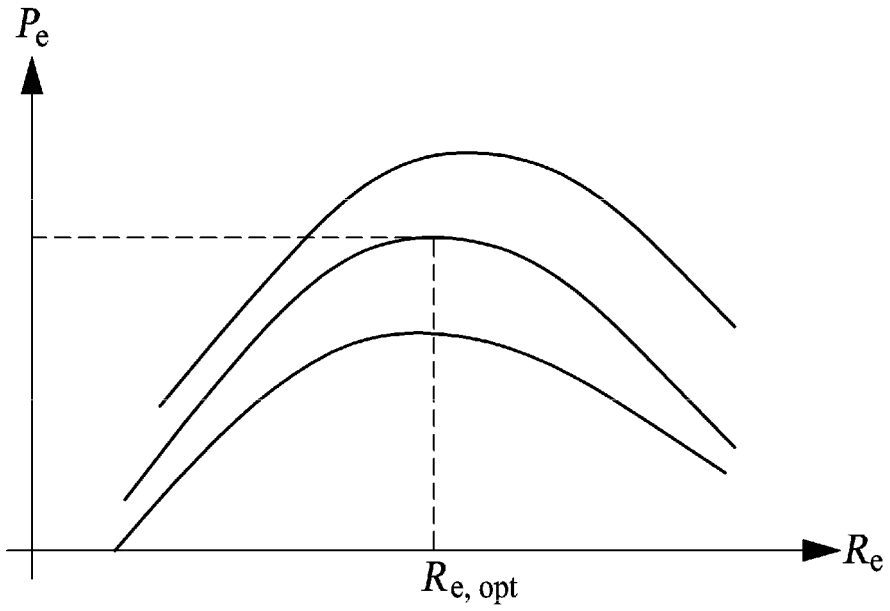
FIG. 10 is a graph showing the change of output power with change of $R_e$ with respect to various values of $C_2$.

FIG. 10 is a graph showing the change of output power with change of $R_e$ with respect to different values of $C_2$.

The values of the second compensation capacitor 623 and n (the number of serially-connected LEDs in the LED array 340 or 640) is set to zero the result from applying a partial differential equation with respect to $R_e$ to Equation 3, as represented by Equation 10. In other words, a certain number of the LEDs may be found where the power of the LED array 340 or 640 becomes the strongest and the LED array 340 or 640 may be arranged to operate with that number of the LED elements, if the LED array 340 or 640 includes n serially-connected LED elements.

$$\frac{\partial P_o}{\partial R_e} = 0 \qquad \text{Equation 10}$$

Further, with Equation 1, solutions for $C_2$ and 'n' can be found by setting $P_o$ to 20 W and solving a simultaneous Equation of Equation 1 and Equation 10.

Such a solution can be obtained from a graph. $P_o$ varies with changes of the values of L, $C_1$, and $C_2$ and depending on $R_e$. For example, in FIG. 10, $C_2$ and $R_e$ can be determined, which satisfy a point where the maximum value of $P_o$ is 20 W from the Power graph obtained by fixing L and $C_1$ and changing $C_2$ and $R_e$. Therefore, when $P_o$ (the output of the LED array 340 or 640) is set to 20 W, it suffices to select the condition where the value of C2 satisfies Equation 10 near 20 W. When $C_2$ is obtained in the above manner, $R_e$ is determined, and with the determined value of $R_e$, the value of n is determined by Equation 1. However, because the value of n takes an integer, one could not find the value of n satisfying Equations 10 and 1 as an accurate integer. Therefore, an integer close to the calculated value can be taken as 'n'. Accordingly, a process of finding n from Equation 10 can be achieved in practice by changing (e.g., increasing) the number of LEDs (i.e., the value of n) to find or measure the value of n to cause the least change in the value of $P_o$. Such a process can be commonly performed for the cases shown in FIGS. 3 and 6.

Although the above description assumes the LED array 340 or 640 includes a plurality of serially-connected LED elements, the present disclosure also applies to the LED array 340 or 640 including a plurality of LED elements serially and parallelly connected with various connection combinations, for obtaining a combination of LED elements serially and parallelly connected, wherein the change of the output power of the LED array 340 or 640 is least as the change depends on adding more of the LED elements.

A method of finding $C_3$ in the case shown in FIG. 6 is to adjust the value of $C_3$ after determining the values of L, $C_1$, $C_2$ and n. In this case, it suffices to adjust the value of $C_3$ such that the PF at the AC input 611 becomes equal to or larger than 0.9.

FIG. 10 is a graph instantiating a case of connecting a conventional lighting load (lagging phase) and a lighting device according to some embodiments (leading phase) in parallel.

As shown in FIG. 10, by connecting a conventional lighting load having a lagging phase in parallel with a lighting device having a leading phase according to some embodiments, the power factor and the THD of the whole system can be improved.

In other words, the change of the system power for when the conventional lighting is replaced with the LED lighting not only exhibits a reduced power consumption with the LED lighting itself due to the characteristics of the LED lighting inherently generating the comparable lighting effect to the fluorescent light with less power consumption, but also provides an increased efficiency of the whole power system by reducing a reactive power of the whole power system that has a reactive power of the lagging phase by providing the power factor having the leading phase.

In the description above, although all of the components of the embodiments of the present disclosure may have been explained as assembled or operatively connected as a unit, one of ordinary skill would understand the present disclosure is not limited to such embodiments. Rather, within some embodiments of the present disclosure, the respective components are selectively and operatively combined in any number of ways.

Although exemplary embodiments of the present disclosure have been described for illustrative purposes, those skilled in the art will appreciate that various modifications, additions and substitutions are possible, without departing from the essential characteristics of the disclosure. Therefore, exemplary embodiments of the present disclosure have been described for the sake of brevity and clarity. Accordingly, one of ordinary skill would understand the scope of the disclosure is not limited by the explicitly described above embodiments but by the claims and equivalents thereof.

[Industrial Applicability]

As described above, the present disclosure is highly useful as it has effects of enhancing characteristics such as output and power factor by using an LED lighting device including a compensation circuit for driving an LED array for LED lighting.

CROSS-REFERENCE TO RELATED APPLICATION

If applicable, this application claims priority under 35 U.S.C §119(a) of Patent Application No. 10-2012-0094892, filed on Aug. 29, 2012 in Korea, the entire content of which is incorporated herein by reference. In addition, this non-provisional application claims priority in countries, other than the U.S., with the same reason based on the Korean patent application, the entire content of which is hereby incorporated by reference.

The invention claimed is:

1. An AC-direct-type LED lighting device, comprising:

a compensation circuit including a compensation inductor and a first compensation capacitor parallelly connected to one terminal of an AC input and a second compensation capacitor connected in series to the parallelly-connected compensation inductor and first compensation capacitor, and configured to compensate the AC input;

a rectifying unit configured to rectify an output from terminals of the second compensation capacitor to obtain a direct current; and an LED array configured to be driven by an output of the rectifying unit, wherein capacities of the first compensation capacitor, the second compensation capacitor and the compensation inductor, and an output voltage of the LED array are determined to cause 0.9 or larger cosine value of a phase, with respect to a voltage of the AC input, of a resulting current, obtained by dividing the voltage of the AC input by a sum of (i) a parallel value of an equivalent impedance $R_e$ of the rectifying unit and the LED array and an impedance of the second compensation capacitor and (ii) a parallel value of an impedance of the compensation inductor and an impedance of the first compensation capacitor.

2. The AC-direct-type LED lighting device of claim 1, wherein the capacities of the first compensation capacitor, the second compensation capacitor and the compensation inductor are set up to cause the phase of the current to have a power factor of a leading phase with respect to the voltage.

3. The AC-direct-type LED lighting device of claim 1, wherein the capacities of the first compensation capacitor, the second compensation capacitor, and the compensation inductor are set up to cause the AC-direct-type LED lighting device to operate in a continuous current mode (CCM) or in a discontinuous current mode (DCM).

4. The AC-direct-type LED lighting device of claim 1, wherein the equivalent impedance $R_e$ is proportional to the output voltage of the LED array and inversely proportional to an output power of the LED array.

5. The AC-direct-type LED lighting device of claim 1, wherein when the value of the compensation inductor has a preset value, the value of the first compensation capacitor has a value that allows $$\frac{1}{2\pi\sqrt{LC_1}}$$

to be equal to or larger than $3*f_s$ and equal to or smaller than $4*f_s$, where $f_s$ is a frequency of the AC input.

6. The AC-direct-type LED lighting device of claim 1, wherein the output voltage of the LED array has a value corresponding to the state that the change of an output power of the LED elements constituting the LED array is least, the change depending on the number of the LED elements.

7. The AC-direct-type LED lighting device of claim 6, wherein the value of the second compensation capacitor allows the output power to have a preset output power value.

8. An AC-direct-type LED lighting device, comprising:

a compensation circuit including a third compensation capacitor parallelly connected to an AC input, a compensation inductor and a first compensation capacitor parallelly connected to one terminal of the AC input, and a second compensation capacitor connected in series to the parallelly-connected compensation inductor and first compensation capacitor, and configured to compensate the AC input;

a rectifying unit configured to rectify an output from terminals of the second compensation capacitor to obtain a direct current; and an LED array configured to be driven by an output of the rectifying unit, wherein capacities of the first compensation capacitor, the second compensation capacitor, the third compensation capacitor and the compensation inductor, and an output voltage of the LED array are determined to cause 0.9 or larger cosine value of a phase, with respect to a voltage of the AC input, of a resulting current $I_1 + I_2$ obtained by adding (i) a first result $I_1$ obtained by dividing the voltage of the AC input by a sum of a parallel value of the equivalent impedance $R_e$ of the rectifying unit and the LED array and an impedance of the second compensation capacitor and a parallel value of an impedance of the compensation inductor and an impedance of the first compensation capacitor and (ii) a second result $I_2$ obtained by dividing the voltage of the AC input by an impedance $(1/j\omega_s C_3)$ of the third compensation capacitor.

9. The AC-direct-type LED lighting device of claim 8, wherein the capacities of the first compensation capacitor, the second compensation capacitor, the third compensation capacitor and the compensation inductor are set up to cause the phase of the resulting current to have a power factor of a leading phase with respect to the voltage.

10. The AC-direct-type LED lighting device of claim 8, wherein the capacities of the first compensation capacitor, the second compensation capacitor, the third compensation capacitor and the compensation inductor are set up to cause the AC-direct-type LED lighting device to operate in a continuous current mode (CCM) or in a discontinuous current mode (DCM).

11. The AC-direct-type LED lighting device of claim 8, wherein the equivalent impedance $R_e$ is proportional to the output voltage of the LED array and inversely proportional to an output power of the LED array.

12. The AC-direct-type LED lighting device of claim 8, wherein when the value of the compensation inductor has a preset value, the value of the first compensation capacitor has a value that allows $$\frac{1}{2\pi\sqrt{LC_1}}$$

to be equal to or larger than $3*f_s$ and equal to or smaller than $4*f_s$, where $f_s$ is a frequency of the AC input.

13. The AC-direct-type LED lighting device of claim 8, wherein the output voltage of the LED array has a value corresponding to the state that the change of an output power of the LED elements constituting the LED array is least, the change depending on the number of the LED elements.

14. An AC-direct-type LED lighting device, comprising:

a compensation circuit including a compensation inductor and a first compensation capacitor parallelly connected to one terminal of an AC input and a second compensation capacitor connected in series to the parallelly-connected compensation inductor and first compensation capacitor, and configured to compensate the AC input;

a rectifying unit configured to rectify an output from terminals of the second compensation capacitor to obtain a direct current; and an LED array configured to be driven by an output of the rectifying unit, wherein capacities of the first compensation capacitor, the second compensation capacitor and the compensation inductor, and an output voltage of the LED array are determined to cause a leading phase, with respect to a voltage of the AC input, of a resulting current obtained by dividing the voltage of the AC input by a sum of (i) a parallel value of an equivalent impedance $R_e$ of the rectifying unit and the LED array and an impedance of the second compensation capacitor and (ii) a parallel value of an impedance of the compensation inductor and an impedance of the first compensation capacitor.

15. An AC-direct-type LED lighting device, comprising:

a compensation circuit including a third compensation capacitor parallelly connected to an AC input, a compensation inductor and a first compensation capacitor parallelly connected to one terminal of the AC input, and a second compensation capacitor connected in series to the parallelly-connected compensation inductor and first compensation capacitor, and configured to compensate the AC input;

a rectifying unit configured to rectify an output from terminals of the second compensation capacitor to obtain a direct current; and an LED array configured to be driven by an output of the rectifying unit, wherein capacities of the first compensation capacitor, the second compensation capacitor, the third compensation capacitor and the compensation inductor, and an output voltage of the LED array are determined to cause a leading phase, with respect to a voltage of the AC input, of a resulting current $I_1 + I_2$ obtained by adding (i) a first result $I_1$ obtained by dividing the voltage of the AC input by a sum of a parallel value of the equivalent impedance $R_e$ of the rectifying unit and the LED array and an impedance of the second compensation capacitor and a parallel value of an impedance of the compensation inductor and an impedance of the first compensation capacitor and (ii) a second result $I_2$ obtained by dividing the voltage of the AC input by an impedance $(1/j\omega_s C_3)$ of the third compensation capacitor.

* * * * *